US005743014A

United States Patent [19]

Giammaruti et al.

[11] Patent Number: 5,743,014

[45] Date of Patent: Apr. 28, 1998

[54] METHOD OF MAKING FIELD SERVICEABLE FILL TUBE FOR USE ON HEAT PIPES

[75] Inventors: Robert J. Giammaruti, North Canton; Morten Licht, Canton, both of Ohio

[73] Assignee: The Babcock & Wilcox Company, New Orleans, La.

[21] Appl. No.: 799,600

[22] Filed: Feb. 12, 1997

Related U.S. Application Data

[62] Division of Ser. No. 539,397, Oct. 5, 1995.

[51] Int. Cl.[6] ..... B23P 15/26

[52] U.S. Cl. ..... 29/890.032

[58] Field of Search ..... 29/890.032, 890.046, 29/890.048, 428; 165/104.21, 104.26, 104.27, 104.11; 228/60, 101

[56] References Cited

U.S. PATENT DOCUMENTS

| | | | |
|---|---|---|---|
| 4,341,000 | 7/1982 | Stockner | 165/104.27 |
| 4,971,142 | 11/1990 | Mirgler | 29/890.032 |
| 5,226,580 | 7/1993 | Harthe et al. | 29/890.032 |
| 5,379,830 | 1/1995 | Itoh | 29/890.032 |
| 5,412,535 | 5/1995 | Chao et al. | 29/890.032 |

FOREIGN PATENT DOCUMENTS

| | | |
|---|---|---|
| 2223587 | 10/1974 | France . |
| 500109 | 1/1939 | United Kingdom . |
| 1405083 | 9/1975 | United Kingdom . |
| 8401601 | 4/1984 | WIPO . |

*Primary Examiner*—Irene Cuda

*Attorney, Agent, or Firm*—Robert J. Edwards; Eric Marich

[57] ABSTRACT

A field serviceable fill tube apparatus for use on a heat pipe employs a quick-disconnect fitting on one end of the heat pipe to facilitate filling, sealing and servicing the heat pipe, both during manufacture and afterwards in the field.

1 Claim, 4 Drawing Sheets

METHOD OF MAKING FIELD SERVICEABLE FILL TUBE FOR USE ON HEAT PIPES

This is a division of application Ser. No. 08/539,397 filed Oct. 5, 1995.

FIELD AND BACKGROUND OF THE INVENTION

The present invention relates in general to the field of heat pipes and, in particular to a new and improved method and apparatus for filling, sealing, and field servicing heat pipes.

Larger size water/carbon steel heat pipes generally incorporate fill tubes through which the working fluid is passed into the heat pipes, and through which the heat pipes are placed under vacuum. In some cases, a union is used to allow for venting of non-condensible gases from the heat pipes after some period of service.

The use of a standard heat pipe fill tube is shown schematically in FIG. 1. During manufacture of the heat pipe 10, one end of a fill tube 12 is welded to a hemispherical or elliptical end cap 14 by means of a weld 16. The heat pipe 10 is then filled with a working fluid schematically indicated at 18, degassed and evacuated to a "hard" vacuum. The heat pipe 10 is then sealed via a tube crimp 20 and a weld 22 at the other end of the fill tube 12. FIG. 2 shows the use of a union or coupling generally designated 30, in combination with two fill tubes, a primary fill tube 32 and a secondary fill tube 34. During manufacture of the heat pipe 10, one end of the primary fill tube 32 is welded to the end cap 14 and the other end is welded to externally threaded portion 36 of union 30. The secondary fill tube 34 is then connected to the primary fill tube 32 via internally threaded portion 38 of union 30. A typical conical bushing 40 fits on a portion 42 of the secondary fill tube 34 within the union or coupling 30 to make the seal. The heat pipe 10 is again filled with the working fluid 18, degassed and evacuated to a "hard" vacuum. The heat pipe 10 is then sealed via a tube crimp 44 and sealing weld 46 on the secondary fill tube 34.

The designs shown in FIGS. 1 and 2 have several drawbacks because each provides for several possible failure points; i.e., at welds 16, 22, 46 and at tube crimp 20, 44. In FIG. 1, the crimp 20 reduces the strength of the fill tube 12, the heat pipe 10 cannot be vented of non-condensible gas after a period of service, and the sampling of non-condensible gas and the making of pressure measurements from a heat pipe 10 requires penetration of the fill tube 12 wall, rendering it unusable as a pressure boundary. In FIG. 2, five possible failure points exist; i.e., at welds 16, 46, at tube crimp 44, and at the seal within union 30. Additionally, venting of the heat pipe 10 in the field is cumbersome, and sampling of non-condensible gas and pressure measurements from the heat pipe 10 again requires penetration of the primary 32 or secondary 34 fill tube wall thus rendering either of them unusable as a pressure boundary. In particular, once any fill tube 12 or 32 is penetrated, the entire heat pipe 10 must be replaced because restoration of the heat pipe 10 in the field is not currently possible.

The manufacturing process for heat pipe 10 also affects the type of fill tube apparatus that can be placed on the end of the heat pipe 10 itself. FIG. 2 represents one known heat pipe 10 construction. It is important to note that some steps in the general manufacturing procedure for this construction involve, inter alia, spinning the heat pipe 10 while the fill tube apparatus is attached. The manufacturing procedure for the heat pipes thus impacts the type of fill tube assembly that can be used because any type of fitting or closure device on the end of the primary fill tube 32 must be axially symmetrical with respect to a longitudinal axis of the heat pipe 10 so that no excessive moment arms occur during spinning of the heat pipe 10. This requirement precludes use of a typical T-type valve having a valve stem and handle which would protrude at an angle from the longitudinal centerline of the heat pipe 10. In addition, such valves could loosen due to vibration during service.

In addition, the heat pipes themselves are charged with a working fluid which, under ambient conditions, is at a vacuum with respect to atmospheric pressure. Thus, any attempt to vent non-condensible gases by merely "cracking" open a union 30 such as shown in FIG. 2, at ambient conditions, would not exhaust gas from the heat pipe, but would rather intake ambient air. For most practical applications, it is thus required to increase the temperature of the heat pipes to a point above 240° F. so that the pressure within the heat pipe is above atmospheric pressure. "Cracking" of the union 30 would thus permit venting of the higher pressure non-condensible gases from the heat pipe to the atmosphere. However, while heating an individual heat pipe might be a relatively straightforward task, these heat pipes are typically part of a larger air heater system wherein such individualized heating is not possible. The entire air heater itself must be elevated in temperature by the use of space heaters and obtaining access for locating same is often extremely difficult. Further, the heat pipes themselves might contain a flammable gas, such as hydrogen, and manually venting same could present a hazard.

Grover (U.S. Pat. No. 4,020,898) and Hoke, Jr. (U.S. Pat. No. 4,799,537) disclose heat pipe apparatus having conventional crimped, soldered or welded end fittings.

Murphy et al. (U.S. Pat. Nos. 4,881,580 and 4,776,389) disclose methods and apparatus for evacuating and filling heat pipes in similar closed vessels. As disclosed in the '580 Murphy et al patent, the heat pipe 16 is processed on a table 14 being held at one end by guides 18, 20 and a clamp 24 having thrust bar 26 and thrust finger 28. A block 22 is provided with a process tube 54 at a hex shank 68 which moves the piston 60 having O-ring 64, 66. Integral with the heat pipe 16 is a threaded valve 40 having an axial bore 44 and cross bores 46. The process tube 54 is to provide a vacuum and for filling of the working fluid into the heat pipe 16. Turning the hex shank 68 unscrews the valve 40 from the heat pipe 16 and allows an open passageway to process tube 54. O-rings on the piston 60 seal the apparatus from the atmosphere.

Mahdjuri-Sabet (U.S. Pat. No. 5,241,950) discloses, in essence, safety means for a heat pipe so that damage to the heat pipe due to excessive condenser temperatures is avoided. Referring to FIGS. 1 and 2 thereof, the heat pipe 1 is provided with a transparent jacket that holds the working fluid and the evaporator, and is interconnected by a conduit 4 to the condenser 2. Located within an expanded portion of the condenser 2 is an annular plug 13 encircling an overflow tube 10 which creates a fluid reservoir 12 therebetween. Helical springs 14 and 15 maintain axial forces on the annular plug, but allow it to move when rising working fluid fills the condenser 2 during heat absorption.

Stockman (U.S. Pat. No. 4,341,000) discloses a method of charging a heat pipe whereby a predetermined amount of fluid may be charged into the heat pipe includes a method of changing fluids as necessary. The heat pipe 12 as provided at its upper end a T-fitting 24 through which is provided an inlet working fluid and which also provides for air exhaust.

A coupling 26 is used to removably connect the T-fitting 24 to the heat pipe 12. Provided in the internal portion of the heat pipe 12 is a vertical stand pipe 38 whose height is predetermined so that a suction pump 32 connected at a lower end thereof will only be able to remove that portion of liquid above the end termination of the stand pipe 38. The height of the stand pipe 38 can be varied as necessary to provide a predetermined level of liquid in the heat pipe 12.

Hartle et al. (U.S. Pat. No. 5,226,580) is of interest as disclosing an automated heat pipe processing system, wherein a heat pipe casing and an end cap is formed into a heat pipe, then cleaned by means of glow-discharge plasma, filled with a working fluid, and fixing the end cap on the heat pipe by inertia welding.

Franco et al. (U.S. Pat. No. 4,586,561) discloses a low temperature heat pipe employing a hydrogen getter. The term "low temperature" as used in Franco et al. means a temperature below 0° C. (32° F.)at which the heat pipe is operational. The patent discusses one of the largest uses of heat pipes at present being the permafrost stabilization of the trans-Alaskan pipeline. The heat pipes under these conditions are contained in vertical support members that are designed to operate in colder months when the permafrost temperature at moderate depths (20 ft.) is above the air temperature. Heat pipes using ammonia as the heat transport medium have been installed using two heat pipes for each vertical support member. During the winter months when the air temperature is below the ground temperature, the heat pipe functions to remove heat from the permafrost thus maintaining its integrity during the subsequent summer months when thawing can potentially occur. A problem with the operation of the heat pipes is the presence of small amounts of non-condensible hydrogen gas which can collect, for example, by a corrosion reaction between water, which may be an impurity in the ammonia and the carbon steel of the pipe. The hydrogen gas accumulates primarily in the condenser section and inhibits the ammonia vapor from condensing at the top of the condensation section. This results in "condenser blockage" and leads to reduced heat removal capability. Thus, the patent is directed to a means or method of removal of such contaminant hydrogen to allow the heat pipe to continue to operate and continue to prevent the permafrost from degrading. Accordingly, the patent discloses a hydrogen getter material, preferably being a zirconium intermetallic alloy, which is effective even in the presence of air and/or water. More specifically, Franco et al. discloses a hydrogen getter assembly for removing contaminant hydrogen gas from an ammonia heat pipe which assembly can be mounted on the pipe on top or on the side, or located inside the pipe on the condensation wall or section. As shown in FIG. 2 of Franco et al., a heat pipe 17 inserted into the permafrost ground 11 has a hydrogen gas getter assembly 23 mounted vertically on top being inserted through cover plate 31. The getter assembly 23 has located therein a getter material 24 contained in getter canister 25 and held in place by retaining element 26 which is sufficiently porous to allow gaseous $NH_3$ and $H_2$ through to contact the getter material. FIG. 3 of Franco et al. shows another embodiment of the heat pipe having a getter assembly 23 mounted on the side of the heat pipe 17 rather than on the top. This embodiment is said to provide easier installation of the getter assembly to the heat pipe since it avoids a double-seal penetration process as generally practiced for the assembly of the heat pipe illustrated in FIG. 2 thereof. The getter assembly can be attached to the assembled and charged heat pipe (which charging is generally performed under vacuum to avoid the entry of moisture and/or air) by conventional hot tapping methods or non-welding penetration methods. FIG. 4 shows a preferred embodiment of the hydrogen getter assembly 23, wherein the canister housing 25 is inserted in the heat pipe wall 17. Hydrogen and ammonia enter into the interior of the canister 25 by means of the communication inlet 27 and the resulting initial pressure is sufficient to break the rupture disk 29. The getter material is retained in position by retaining element 26 which is porous and permeable to hydrogen and ammonia but is inert and has sufficient strength to provide a barrier to the movement of the getter material into the heat pipe itself. In addition, it is stated that there may also be present a valve (not shown) positioned between the canister 25 and exterior condensation wall and operating with the communication inlet 27. The valve 28 is said to be designed to prevent external leakage of ammonia at low temperatures and use of the valve is optional in preparing the heat pipe by non-welding penetration but is preferred when utilizing, for example, hot tapping methods. In addition to the valve in the communication inlet 27, it is stated that there can optimally be joints formed by fittings, such as quick-connects, which allow for closing and detaching the canister after use and protecting the canister contents from air, and the heat tube atmosphere from escaping, during the detachment step.

While Franco et al. discloses that hydrogen getter assemblies can be removably coupled to heat pipes via quick-connects, he neither teaches nor suggests use of such an assembly during the filling, sealing or field servicing of such heat pipes. As indicated earlier, various servicing operations may have to be performed on heat pipes once they have been installed in the field. These include the tasks of: measuring the internal heat pipe pressure to determine how much non-condensible gas is present; obtaining samples of such non-condensible gases for analysis; venting non-condensible gases from the heat pipe; obtaining a sample of the working fluid from the heat pipe for analysis; and performing internal visual inspections of the heat pipe.

Franco et al. is also not particularly concerned with the manufacturing process for heat pipes. Many heat pipes are designed to have spirally wound aluminum fins present on both the evaporator and condenser sections. During the finning process, the heat pipe is spun at a high speed of rotation. Imbalances cannot be tolerated during such finning processes. Further, the addition of fins to heat pipes, particularly carbon steel fins, add significant weight to the heat pipe and therefore it is not practical from a manufacturing standpoint to fill and seal the heat pipe after it has been finned. Additionally, since heat pipes require a specified internal surface cleanliness, finning the heat pipes prior to the welding of the end cap and the like increases the chance of not meeting this requirement due to flash rust concerns. Further, if it is determined that the heat pipes do require cleaning, it would certainly be easier to do this without the fins being present. Finally, the fins on some portions of heat pipes, particularly the condenser side of the heat pipes, may use aluminum fins which are a much softer material then carbon steel. Such fins would most certainly be damaged beyond repair if manufacture of the heat pipe were completed after the fins were attached to the tube itself.

It is thus clear that an improved method and apparatus for filling, sealing and field servicing individual heat pipes is desirable.

SUMMARY OF THE INVENTION

The present invention provides a solution to these problems by using a high temperature, high pressure disconnecting valve means in place of a union for use during and after manufacture of the heat pipe. During manufacture of a heat pipe, one end of the fill tube is welded to the end cap and the opposite end of the fill tube is connected to a compression fitting of the disconnecting valve means. From this point, the heat pipe can then be filled with the working fluid, degassed and evacuated to a "hard" vacuum. The disconnecting valve means is fitted with a protective plug to permit the disconnecting valve means to operate at a higher operating temperature and pressure than would otherwise be possible if only the disconnecting valve means were provided at the end of the fill tube. The protective plug also prevents dirt from damaging the internal mechanism of the disconnecting valve during operation.

The use of the disconnecting valve means in combination with the fill tube thus provides easier access to the inside of the heat pipe, and simplifies the current manufacturing process while improving the quality and reliability of the heat pipe product. In the present invention, the disconnecting valve means itself can be a type of quick-connect which operates in an analogous fashion to quick-disconnect fittings or couplings provided on common air hose lines. One-half of the disconnecting valve remains on the heat pipe; the other half would be "clipped" on as needed during manufacture, or in the field, connected to a hose and suitable equipment (tanks, vacuum pumps etc.) to allow filling, venting, or servicing.

Accordingly, one aspect of the present invention is drawn to a spirally-finned heat pipe apparatus which has a longitudinal axis of symmetry, employs a water-based working fluid, and which operates with an internal pressure/temperature range from approximately ambient temperature and pressure up to approximately 100 psig and 400° F., and which can be repeatedly and easily serviced in the field. The spirally-finned heat pipe apparatus comprises a cylindrical heat pipe tube having end caps welded thereto. The heat pipe apparatus also comprises a fill tube welded and fluidically connected at a first end thereof to one end cap, the fill tube having a longitudinal axis of symmetry coaxial with the heat pipe apparatus longitudinal axis of symmetry. The heat pipe further comprises a disconnecting valve means fluidically connected to a second end of the fill tube, for providing repeatable access to and resealing of an internal portion of the heat pipe, the disconnecting valve means also having a longitudinal axis of symmetry coaxial with the heat pipe apparatus longitudinal axis of symmetry and an outside diameter not greater than 0.95 of an outside diameter of the cylindrical heat pipe tube to permit installation of the heat pipe apparatus through an aperture in a tube sheet.

Another aspect of the present invention is drawn to a method of manufacturing a field-serviceable, spirally-finned, cylindrical heat pipe apparatus which has a longitudinal axis of symmetry. The method comprises several steps. End caps are welded to each end of a cylindrical heat pipe tube. A first end of a fill tube is welded to one of the end caps to provide a fluidic passage therethrough which provides access into an internal portion of the cylindrical heat pipe tube. Disconnecting valve means are fluidically connected to a second end of the fill tube so as to provide easy and repeatable access to and resealing of an internal portion of the cylindrical heat pipe tube. The cylindrical heat pipe tube is evacuated and filled using the disconnecting valve means. The method finally comprises the step of spinning the cylindrical heat pipe tube about its longitudinal axis of symmetry and applying the spiral fins thereto as the cylindrical heat pipe tube spins.

Yet another aspect of the present invention is drawn to a method of field-servicing a heat pipe apparatus having disconnecting valve means provided on a fill tube fluidically connected to an end cap thereof, the disconnecting valve means having a first end removably and fluidically connected to the fill tube and a second end provided with a removable protective plug. The protective plug is removed from the second end of the disconnecting valve means to provide access to an internal portion of the heat pipe apparatus. A stem portion is then coupled to the second end of the disconnecting valve means, to provide a fluidic passage through the fill tube into the internal portion of the heat pipe apparatus.

The various features of novelty which characterize the invention are pointed out with particularity in the claims annexed to and forming a part of this disclosure. For a better understanding of the invention, its operating advantages and the specific benefits attained by its uses, reference is made to the accompanying drawings and descriptive matter in which preferred embodiments of the invention are illustrated.

DESCRIPTION OF THE PREFERRED EMBODIMENTS

Figure 1:
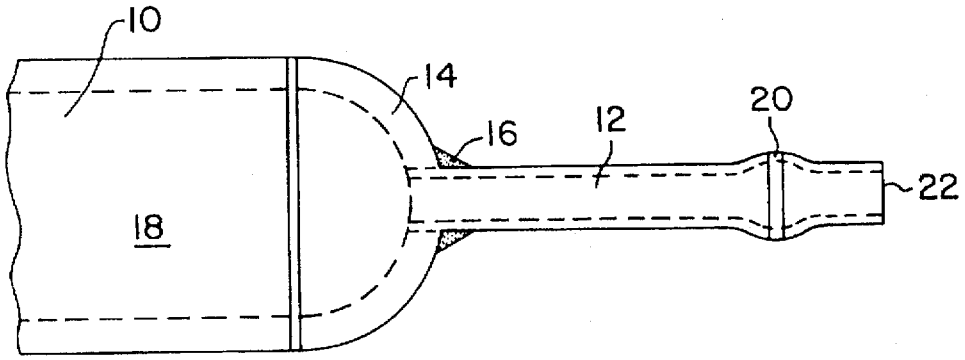
FIG. 1 PRIOR ART
FIG. 1 represents one prior art heat pipe fill tube construction.
Figure 2:
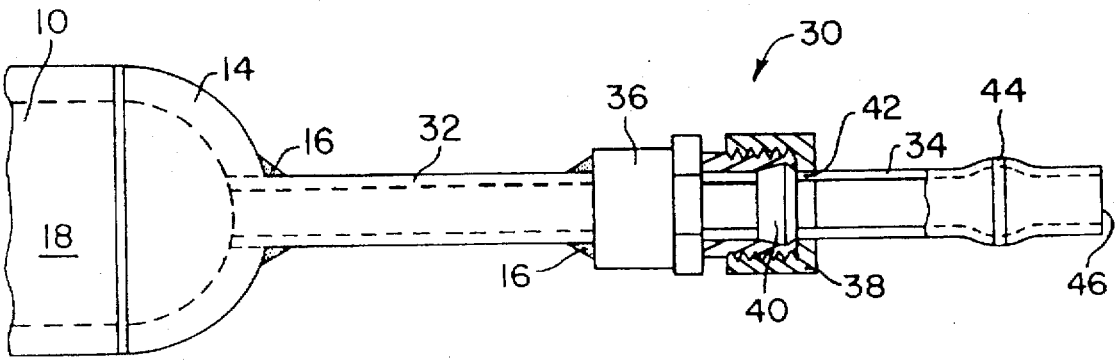
FIG. 2 PRIOR ART
FIG. 2 represents another prior art heat pipe fill tube construction employing primary and secondary fill tubes and a union therebetween.
Figure 3:
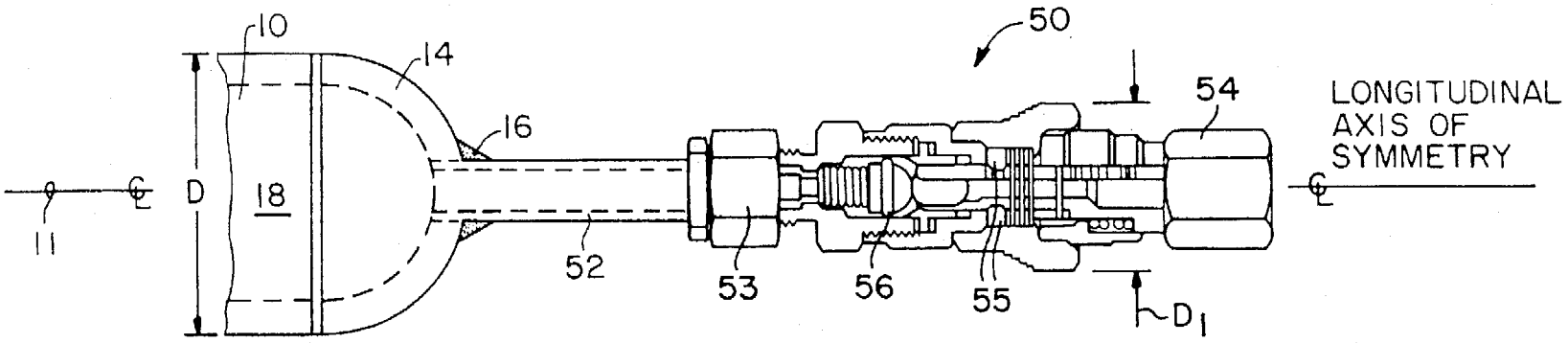
FIG. 3 represents the improved heat pipe construction employing the field serviceable fill tube of the present invention and having a protective plug inserted in a rear portion of the disconnecting valve.

Referring to the drawings generally, wherein like numerals designate the same or functionally similar parts, and to FIG. 3 in particular, there is shown one embodiment of the present invention. The heat pipe 10 has a longitudinal axis of symmetry 11 and a hemispherical or elliptical end cap 14. One end of a fill tube 52 having a longitudinal axis of symmetry coaxial with that of the heat pipe 10 is welded to hemispherical or elliptical end cap 14 by means of weld 16. According to the invention, the other end of the fill tube 52 is connected to disconnecting valve means generally designated 50. The heat pipe 10, fill tube 52, and disconnecting valve means 50 are fluidically interconnected so as to facilitate filling, sealing and evacuation of the heat pipe 10 via the disconnecting valve means 50 both during manufacture and subsequently in the field. Disconnecting valve means 50 advantageously comprises a quick-connect type of disconnecting valve such as a Swagelok® quick-connect (who also manufactures the prior art unions of FIG. 2). (Swagelok® is a registered trademark of the Swagelok Quick-Connect Co., Hudson, Ohio.) The disconnecting valve means 50 also has a longitudinal axis of symmetry coaxial with that of the heat pipe apparatus longitudinal axis of symmetry 11 and an outside diameter $D_1$ preferably not greater than 0.95 of an outside diameter D of the cylindrical heat pipe 10 tube to permit installation of the heat pipe apparatus through an aperture in a tube sheet of a heat pipe air heater (not shown). In any event, the outside diameter $D_1$ of the disconnecting valve means 50 must be less than the outside diameter D of the cylindrical heat pipe 10 so that the disconnecting valve means 50 can be easily inserted through the aperatures in the tube sheets during construction.

As shown in FIG. 3, the disconnecting valve means has a front portion 53 that is connected to the fill tube 52 by means of a compression fitting contained therein comprising the same design conical bushing 40 and threaded portion 38 shown in FIG. 2. Disconnecting valve means 50 is also provided with a removably coupled protective plug 54 to permit it and the associated heat pipe 10 and fill tube 52 to operate at a higher operating temperature and pressure than would otherwise be possible. Protective plug 54 is secured to disconnecting valve means 50 by internal locking mechanism 55, and also prevents dirt from accumulating in disconnecting valve means 50. Removing protective plug 54 from disconnecting valve means 50 permits its body valve O-ring 56 to seal heat pipe 10 and fill tube 52.

Figure 3A:
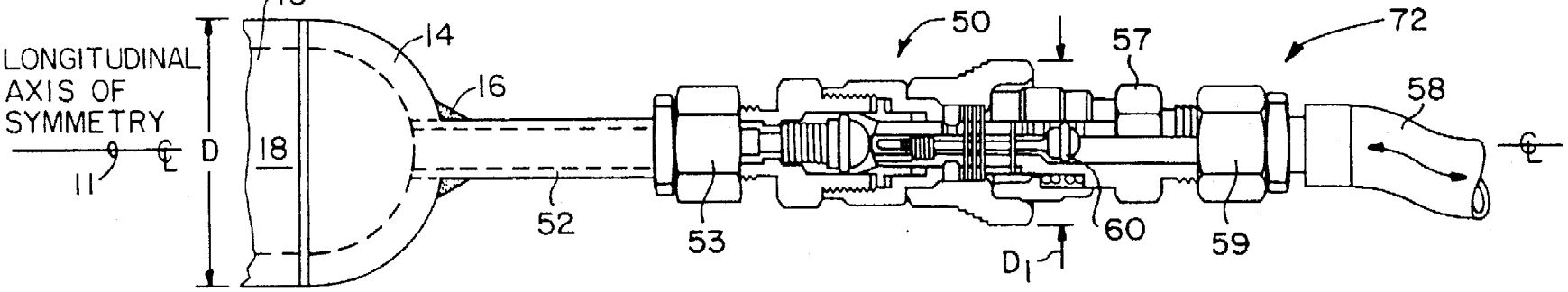
FIG. 3A represents the improved heat pipe construction with a hose and fitting inserted in the rear portion of the disconnecting valve to allow filling, venting, or servicing.

Referring to FIG. 3A, a stem portion 57 of the disconnecting valve means 50 is removably and sealably engagable with the front potion 53 to effect any filling, sealing and servicing of the heat pipe 10, both during manufacture and afterwards in the field. Flexible hose 58 is fluidically connected to the stem portion 57 by means of another compression fitting 59. During manufacture the heat pipe 10 can be filled with the working fluid, degassed and evacuated to a "hard" vacuum through flexible hose 58.

A Double End Shut-Off (DESO) O-ring 60 seals stem portion 57 and flexible hose 58 when stem portion 57 is disconnected from disconnecting valve means 50. DESO O-ring 60 enables the pressure in flexible hose 58 to be maintained when stem portion 57 is disconnected from one heat pipe 10 and connected to another heat pipe 10. The combination of elements 57, 58, 59, and 60 will be generally referred to as coupling 72, or as being removably coupled at 72, in the following portions of this description.

Heat pipe 10 can thus be serviced in the field without the requirement of heating the heat pipe 10 to 240° F. for venting non-condensible gases.

The use of the disconnecting valve means 50 in combination with the fill tube 52 thus provides easier access to the inside of the heat pipe 10, and simplifies the current manufacturing process while improving the quality and reliability of the heat pipe product. In the present invention, the disconnecting valve means 50 itself can be a type of quick-connect which operates in an analogous fashion to quick-disconnect fittings or couplings provided on common air hose lines. One-half of the disconnecting valve means 50 remains on the heat pipe 10; the other half would be "clipped" on as needed during manufacture, or in the field, connected to a hose and suitable equipment (tanks, vacuum pumps etc.) to allow, filling, venting, or servicing.

Swagelok®-type quick-connects are known which can be adapted for use in temperature and pressure ratings of 100 psig and 400° F. Further development of the seal materials, namely the O-rings, to meet the service pressure and temperature requirements above this range will be necessary for other heat pipe applications.

Preferably the invention employs "off the shelf" Swagelok® type quick-connects on the heat pipes 10, as limited by the cited temperature and pressure ranges. For example, Swagelok® instrumentation brochure No. QC-590-1, April 1993, discloses one example of the particular type of couplings which can be adapted to this heat pipe 10 application that have pressure ratings up to 3,000 psig, but at 70° F. Similarly, temperature ratings with various types of O-rings extend the range of these devices up to the 400° F. range, but only at 100 psig. The selection of the particular type of disconnecting valve means 50 and their materials of construction will be determined by the temperature and pressure under which the heat pipe 10 is expected to operate.

A plurality of heat pipes 10 using the present invention would be employed in the "cold end" portion of a gas to air heat transfer device; i.e., a heat pipe air heater (not shown). The "cold end" portion of such an air heater is that location wherein the cooled gas exits from the air heater, and the cold inlet air enters. Similarly, the "hot end" of such an air heater is that location wherein the hot gas enters and the heated air exits. The present invention would generally not be applied to the "hot end" portions of the air heater because of the heat pipe 10 operating temperature and pressure. Sometimes hydrogen or other noncondensible gases are produced in the heat pipes 10. On the "hot end" portion of the air heater, any hydrogen gas produced is under a sufficient pressure that will cause it to be compressed and only disable a small portion of the heat pipe itself. At these elevated pressures, the hydrogen gas is actually driven out through the walls of the heat pipe 10, and thus only causes the loss of a small portion of the effective length of the heat pipe 10. In contrast, heat pipes operating on the "cold end" of the air heater are not operating at such a high pressure that would cause the hydrogen gas to be either compressed only at a localized end of the heat pipe 10, or to be driven through the walls. Therefore, a larger portion of the length of the heat pipe 10 is disabled when an mount of hydrogen gas accumulates. These are the heat pipes 10 which are particularly suited for application of the present invention, since the heat pipe at the "cold end" of the air heater may be operating only into the approximately 320° F. range, wherein the saturation pressure at this temperature is 89.6 psia.

Figure 4:
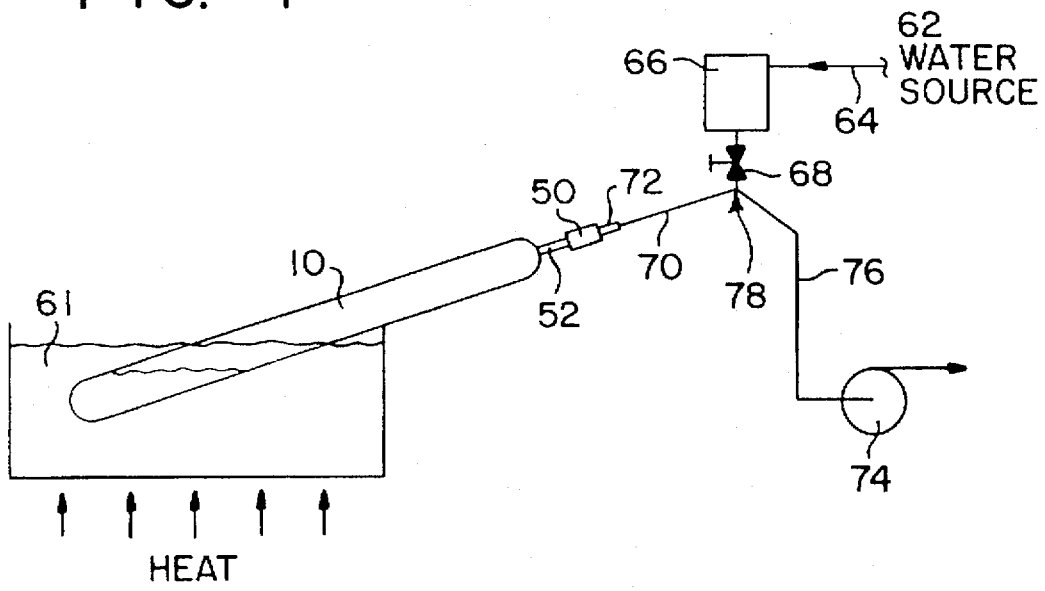
FIG. 4 is a schematic representation of the degassing/evacuation step used in the manufacturing process for heat pipes using the invention.

Referring to FIG. 4 there is shown a schematic representation of the degassing/evacuation step used in the manufacturing process for heat pipes using the present invention. One end of the heat pipe 10 and its associated disconnecting valve means 50 is partially immersed in a degas tank 61 to which heat is applied as shown to increase the temperature of the contents of the heat pipe 10. Water is provided from a source 62 via line 64 through a volume measuring means 66 of known construction. A valve 68 and a line 70 are provided and removably coupled at 72 to disconnecting valve means 50. A vacuum pump 74, capable of producing vacuums as low as approximately −30" Hg, is connected via line 76 to a tee connection 78 so as to draw a vacuum on the heat pipe 10. Once the filling and degassing of heat pipe 10 is complete, the vacuum providing equipment and water providing equipment would be decoupled from the disconnecting valve means 50. The heat pipe 10 would then be available for further processing. The heat pipe 10 itself has an outside diameter ranging from approximately 1¼ inches to approximately 2 inches, and the spiral fins applied to the outside surface thereof would have an outside diameter ranging from approximately 2¼ inches to approximately 3½ inches. Since the outside diameter $D_1$ of the preferred disconnecting valve means is approximately 1 inch, the resulting combination achieves the desired difference in diameters between that of the disconnecting valve means 50 and the heat pipe 10.

Figure 5:
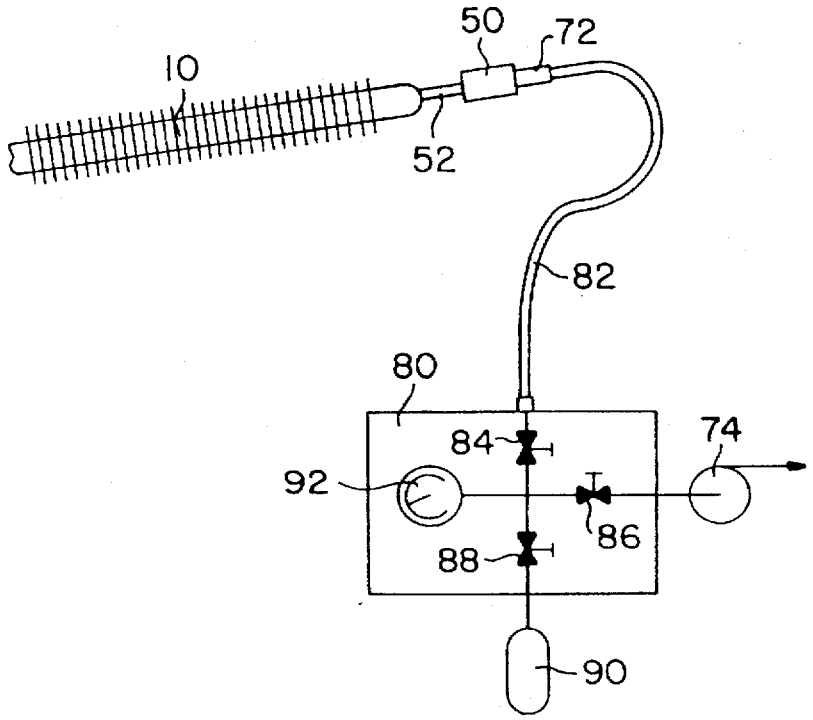
FIG. 5 is a schematic representation of equipment that would be used to field service a heat pipe made and used according to the invention.

FIG. 5 shows a schematic representation of equipment that would be used to field service a heat pipe made and used according to the present invention. FIG. 5 shows a single heat pipe 10 with its associated fill tube 52 and disconnecting valve means 50. A portable field servicing apparatus 80, and a vacuum pump 74 having the same vacuum producing abilities as described earlier, would be provided to perform certain field servicing operations as described earlier. Apparatus 80 is connected to the heat pipe 10 via a flexible line or hose 82 of desired length, and removably coupled thereto at 72. Apparatus 80 would advantageously comprise an arrangement of valves 84, 86, and 88 to permit fluidic communication between the heat pipe 10 (via line 82) and the vacuum pump 74, a gas sample container 90, and a pressure gage 92 as shown. Once the field servicing operations are complete, the portable field servicing apparatus 80 would be disconnected from the disconnecting valve means 50.

Figure 6A:
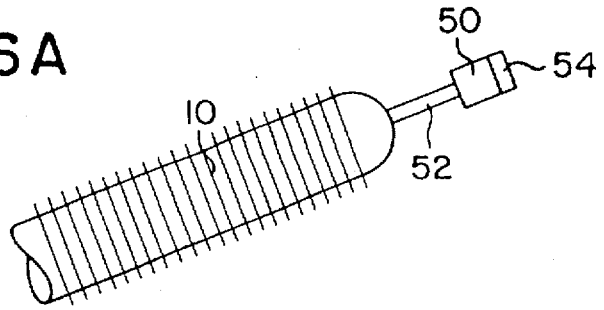
FIGS. 6A–6D are several schematic representations of different field servicing operations that are possible through use of the invention.
Figure 6B:
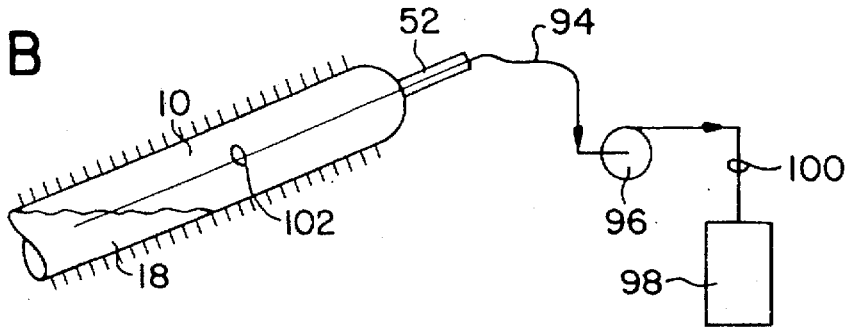
Figure 6C:
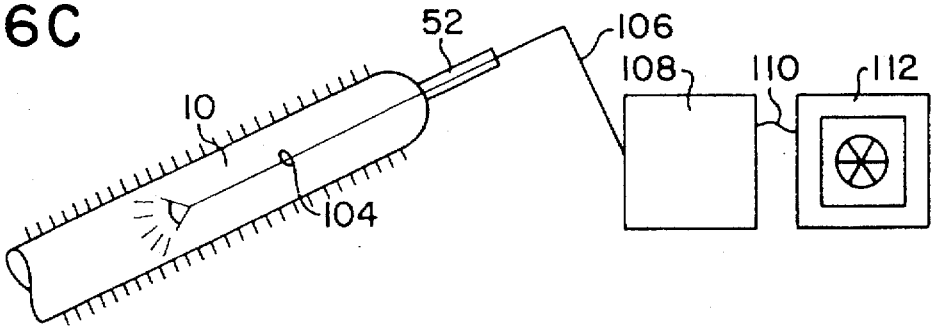
Figure 6D:
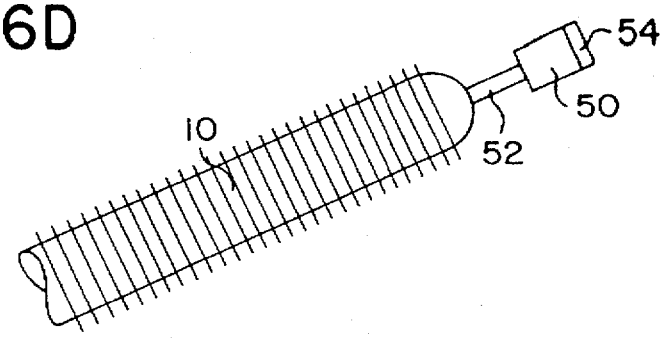

FIGS. 6A–6D illustrate several other field servicing operations that are possible through use of the present invention. FIG. 6A shows the heat pipe 10 before servicing. FIGS. 6B and 6C show how samples of working fluid 18 or visual inspections of the internal portion of the heat pipe 10 would be performed. For these field servicing operations, the protective plug 54 and the disconnecting valve means 50 would be removed to allow an open passageway through the fill tube 52 into the heat pipe 10. The compression fitting 53 allows this to be accomplished. A line 94 and fluid pump means 96 would be used to obtain a sample of the fluid 18 contained within the heat pipe 10 and provide it to a liquid sample container 98 via line 100. A long, slender probe or sample line 102 would be extended down into the heat pipe 10 for this purpose, as shown in FIG. 6B. Alternatively, as shown in FIG. 6C, a visual inspection of the interior portion of the heat pipe 10 could be facilitated by means of a known fiberoptic borescope 104 operatively connected via line 106 to video and light providing equipment 108 connected via line 110 to a video monitor 112 in known fashion. At the conclusion of such inspections and/or samplings, the disconnecting valve means 50 and protective plug 54 would be reattached, after the heat pipe 10 had been restored to its working condition, as shown in FIG. 6D.

While specific embodiments of the invention have been shown and described in detail to illustrate the application of the principles of the invention, those skilled in the art will appreciate that changes may be made in the form of the invention covered by the following claims without departing from such principles. In some embodiments of the invention, certain features of the invention may sometimes be used to advantage without a corresponding use of the other features. Accordingly, all such changes and embodiments properly fall within the scope of the following claims.

We claim:

1. A method of manufacturing a field-serviceable, spirally-finned, cylindrical heat pipe apparatus having a longitudinal axis of symmetry, comprising the steps of:

welding end caps to each end of a cylindrical heat pipe tube;

welding a first end of a fill tube to one of the end caps to provide a fluidic passage therethrough which provides access into an internal portion of the cylindrical heat pipe tube;

fluidically connecting disconnecting valve means to a second end of the fill tube so as to provide easy and repeatable access to and resealing of an internal portion of the cylindrical heat pipe tube;

evacuating and filling the cylindrical heat pipe tube using the disconnecting valve means; and spinning the cylindrical heat pipe tube about its longitudinal axis of symmetry and applying the spiral fins thereto as the cylindrical heat pipe tube spins.

* * * * *